US005813519A

United States Patent [19]

Gotoh

[11] Patent Number: 5,813,519

[45] Date of Patent: Sep. 29, 1998

[54] LIGHTED SWITCH APPARATUS

[75] Inventor: Kazunori Gotoh, Miyagi-ken, Japan

[73] Assignee: Alps Electric Co., Ltd., Japan

[21] Appl. No.: 806,971

[22] Filed: Feb. 26, 1997

[30] Foreign Application Priority Data

May 3, 1996 [JP] Japan ..... 8-047466

[51] Int. Cl.[6] ..... H01H 9/26; H01H 9/00

[52] U.S. Cl. ..... 200/313; 200/5 R; 200/314; 200/315

[58] Field of Search ..... 200/310, 311, 200/312, 313, 314, 315, 316, 317, 5 R; 362/23, 29, 26, 30, 352

[56] References Cited

U.S. PATENT DOCUMENTS 4,385,221 5/1983 Dorfler ..... 200/314

4,975,547 12/1990 Nakayama et al. ..... 200/5 R

*Primary Examiner*—Michael L. Gellner

*Assistant Examiner*—Michael J. Hayes

*Attorney, Agent, or Firm*—Brinks Hofer Gilson & Lione

[57] ABSTRACT

A lighted switch apparatus including a slider having two indicator portions spaced apart in the sliding direction, a pair of light-intercepting portions, each preventing light of a lamp from reaching the associated indicator portion located at the side towards which the slider is slid, and an opening formed between the pair of light-intercepting portions to allow transmission of the light from the lamp to the indicator portions of the slider and illuminate the indicator portions. In the lighted switch apparatus, when the slider is in the neutral position, both of the indicator portions are illuminated by the light transmitted through the opening. When the slider is slid in one direction, the indicator portion at the side towards which the slider is slid is prevented from being illuminated by the light-intercepting portion, whereas the other indicator portion is illuminated by the light from the lamp opposing the opening. Accordingly, it is possible to provide a lighted switch apparatus which provides a reliable indication of the switching state, even when used in dark places, by indicating an apparatus to be operated by the switch apparatus, or direction or function thereof, on a slide switch indicator portion, as a result of a switching operation performed when the slider is slid in one direction.

2 Claims, 4 Drawing Sheets

LIGHTED SWITCH APPARATUS

BACKGROUND OF THE INVENTION

1. Field of the Invention

The present invention broadly relates to a switch apparatus for switching between an on and off states and between functions of an apparatus to be operated by the switch apparatus, and, more particularly, to a lighted switch apparatus in which the position of the operating member or switching state is indicated by a light source means in the switch apparatus.

2. Description of the Related Art

Conventionally, various switch apparatuses have been provided for switching between an on and off states and between set plurality of functions of an apparatus to be operated by the switch apparatus. Smaller switch apparatuses are demanded when an apparatus to be operated by the switch apparatus is made smaller or only a limited space is available for setting the apparatus to be operated by the switch apparatus. To respond to such a demand, a small switch apparatus which can set a plurality of functions by selectively operating a plurality of switch elements using one operating member has been provided.

The mirror switch apparatus is an example of such a switch apparatus, which is used to remotely operate from the driver's seat the angles of the left and right mirrors on the vehicle body by the driving power of the motor. The mirror switch apparatus has a change-over switch and an angle adjustor switch, both of which are provided in one housing. The change-over switch is used for switching to the left mirror or to the right mirror. The angle adjustor switch has one knob portion which can be tilted in any direction for adjusting the tilting angle of the switched mirror in the vertical or horizontal directions.

Such a switch apparatus mounted in a vehicle may be operated in the evening or at night when it is dark out. Accordingly, in dark places, a lighted switch apparatus incorporating a lighting device is used to permit the driver to know the position and switching state of the switch apparatus. When two switches are built in the above-described mirror switch apparatus close to each other, there is, in particular, a demand for a lighting means which easily allows the operator to know the current position of the change-over switch or the vertical or horizontal operating positions even in dark places.

An example of a conventional lighted switch apparatus is disclosed in Japanese Unexamined Utility Model Publication No. 62-153719. The conventional switch apparatus comprises one light-emitting member provided at one end of the bottom portion of the switch body and a slide knob capable of sliding above the light-emitting member. The slide knob has a knob portion projecting from the switch body and a transparent member having one end positioned at the knob portion and the other end positioned so as to be above the light-emitting member when the slide knob is slid in one direction. Therefore, sliding the slide knob such that an end of the transparent member is positioned upwardly of the light-emitting member allows the operator to distinguish between the on and off states of the switch apparatus.

However, when illumination occurs only when the switch apparatus is set in one of the switching states, so that illumination does not occur in the other switching state, the operator cannot even know where the switch apparatus is in the dark, which is very inconvenient. Accordingly, in the above-described switch apparatus, light-emitting members which emit different colors are provided on both bottom ends of the switch body. When the transparent member receives light from one of the light-emitting members, it does not receive light from the other light-emitting member, so that illumination occurs in either of the switching states.

Such a conventional switch apparatus requires two light-emitting members for illumination in both switching directions, resulting in higher costs. In addition, the switching states can be distinguished only by the illumination color of the knob portion, making it necessary for the operator to get used to using the apparatus to be operated by the switch apparatus in order to find out the switching state from the illumination color. Further, switching can only be performed based on the illumination colors, which prevents the indication of the on and off states of the switch from being changed, making it difficult for inexperienced operators of the apparatus to be operated by the switch apparatus to find out the switching state of the switch apparatus.

SUMMARY OF THE INVENTION

Accordingly, a first object of the present invention is to provide a lighted switch apparatus which can reliably indicate the switching state even in dark places by indicating on a slide switch indicator portion the apparatus, which operates as a result of switching operations, or the direction or function of the apparatus. In such a switch apparatus, the switching condition can easily be known by the operator in dark places by illuminating the slide switch indicator portions when the switch apparatus is in the neutral position.

A second object of the present invention is to provide a lighted switch apparatus which, in addition to performing in the above-described manner disclosed in the first object, can illuminate two switch indicator portions by one light source means.

To achieve the first object, according to a first form of the present invention, there is provided a lighted switch apparatus, comprising: a slider having two indicator portions slidably disposed and spaced apart in the sliding direction; a contact portion for allowing switching operations by sliding the slider; light source means for illuminating the indicator portions of the slider; a pair of light-intercepting portions, each preventing the light from the light source means from reaching the associated indicator portion disposed at the end towards which the slider is slid; and an opening formed between the pair of light-intercepting portions for allowing transmission of the light from the light source means to the indicator portions in order to illuminate the indicator portions, wherein when the slider is in the neutral position both of the indicator portions are illuminated by the light transmitted through the opening from the light source means; and wherein when the slider is slid in one direction, the indicator portion at the side towards which the slider is slid is prevented from being illuminated by the light-intercepting portion at the side towards which the slider is slid, whereas the other indicator portion is illuminated by the light from the light source means opposing the opening.

To achieve the second object, according to a second form of the present invention, there is provided a lighted switch apparatus, comprising: four direction switch portions for performing switching between multiple directions by operating a paddle knob in four directions; one light source means disposed below the four direction switch portions; a light-guiding member having an opening for allowing positioning of the light source means so as to extend beyond the light source means, and disposed outwardly of the four direction switch portions; a four direction switch indicator portion disposed at the paddle knob and illuminated by the light from the light source means extending beyond the opening of the light-guiding member; a slide switch portion having a slider which allows the light of the light source means transmitted from the light-guiding means to impinge upon the switch portion and slides in a direction perpendicular to the longitudinal direction of the light-guiding member; slide switch indicator portions spaced apart in the sliding direction of the slider; reflecting surfaces, disposed in the slider in correspondence with the slide switch indicator portions, for reflecting the light from the light-guiding member to the slide switch indicator portions; a pair of light-intercepting portions, each preventing the light from the light source means from reaching the associated slide switch indicator portion at the side towards which the slider is slid; and an opening formed between the pair of light-intercepting portions for allowing transmission of the light from the light source means to the slide switch indicator portions of the slider to illuminate the slide switch indicator portions, wherein the four direction switch indicator portions are illuminated by the light from the light source means extending beyond the opening of the light-guiding member; and wherein the light-guiding member guides the light from the light source means to the reflecting surfaces of the slider, so that when the slider is in the neutral position both of the slide switch indicator portions are illuminated by the light transmitted through the opening from the light source means, and when the slider is slid in one direction the slide switch indicator portion at the side towards which the slider is slid is prevented from being illuminated by the light-intercepting portion at the side towards which the slider is slid, whereas the other of the slide switch indicator portions is illuminated by the light from the light source means opposing the opening.

DESCRIPTION OF THE PREFERRED EMBODIMENT

A description will now be given of a preferred embodiment of the present invention, with reference to the drawings. A mirror switch apparatus is used to describe the embodiments.

Figure 1:
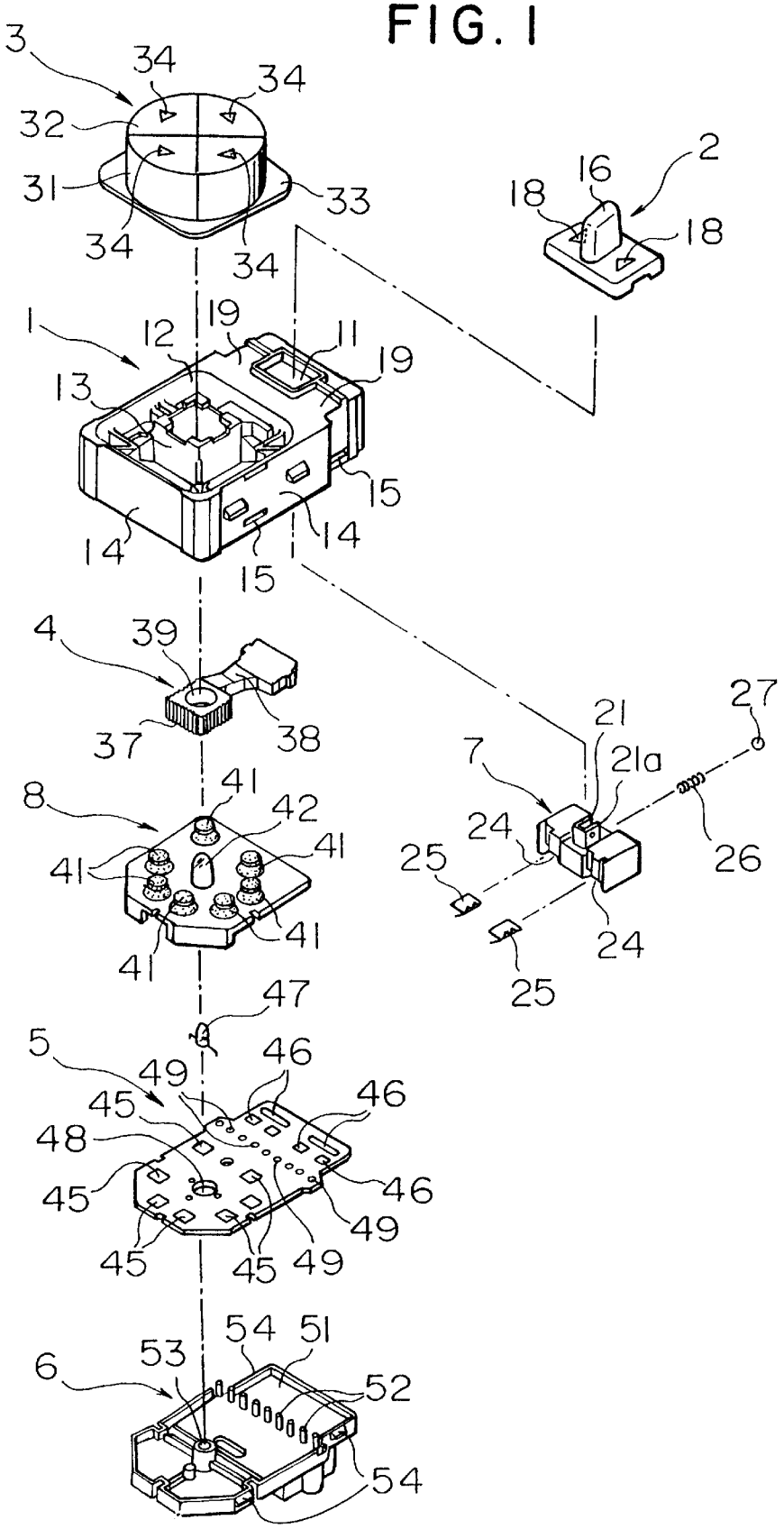
FIG. 1 is an exploded perspective view of an embodiment in accordance with the present invention.
Figure 2:
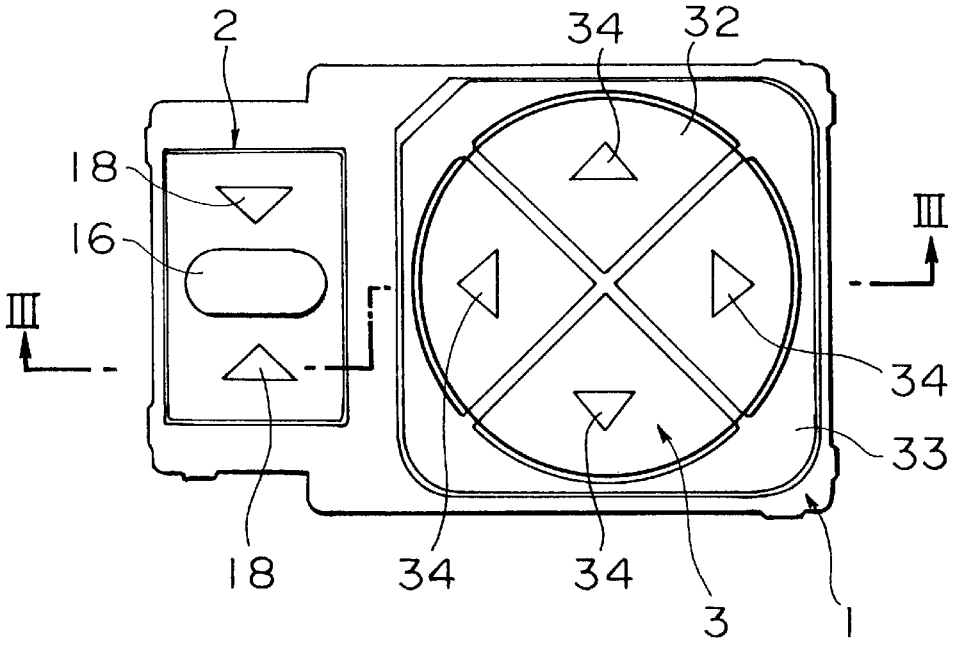
FIG. 2 is a plan view of FIG. 1.
Figure 3:
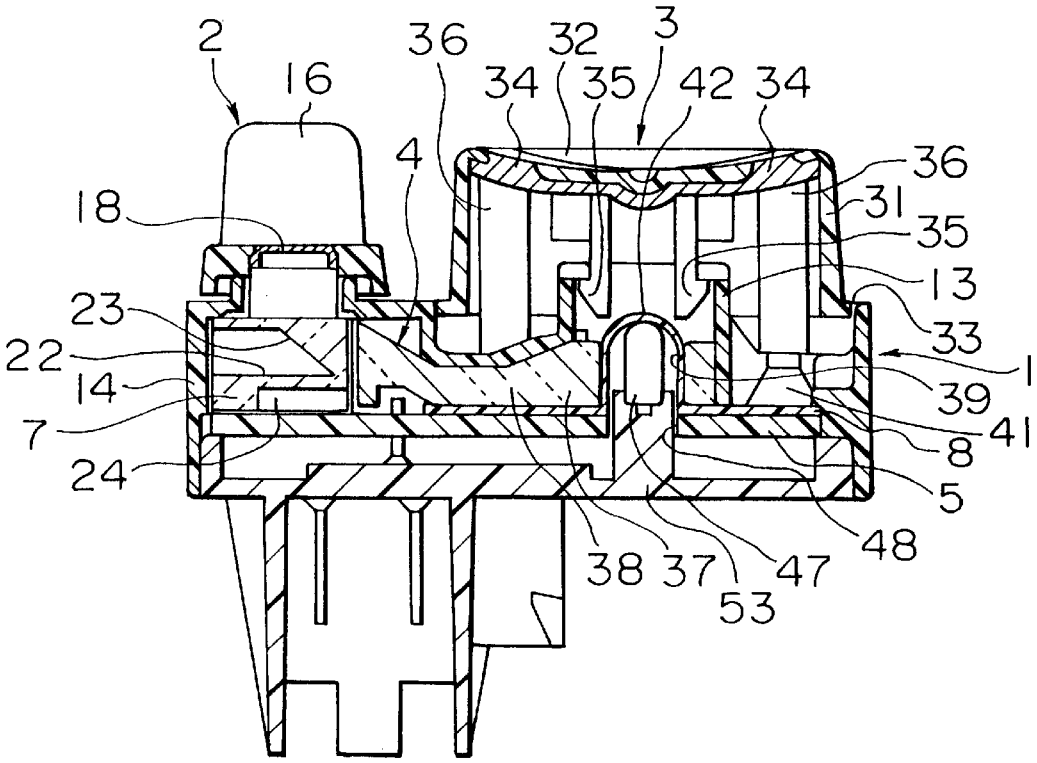
FIG. 3 is a longitudinal side elevational view cut along line III—III of FIG. 2.
Figure 4:
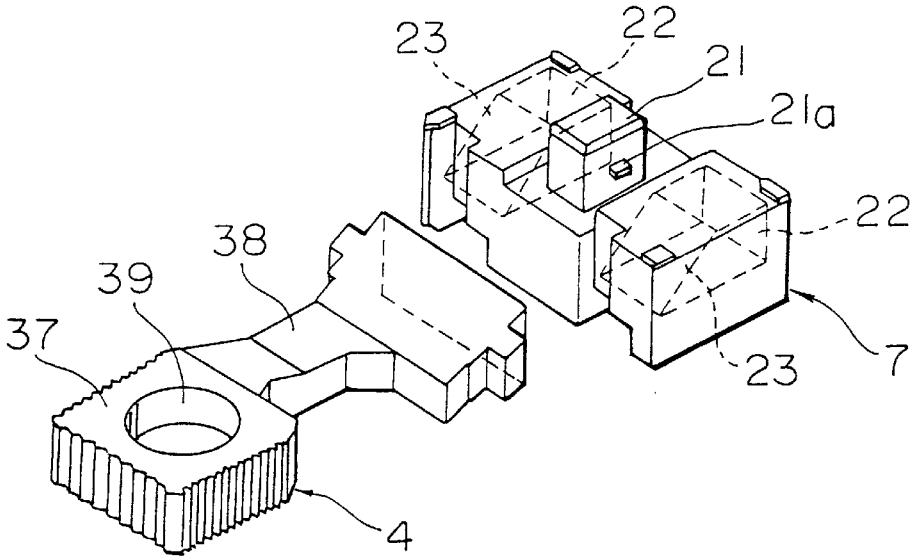
FIG. 4 is a perspective view of the light-guiding member and the slider in the embodiment of the present invention.
Figure 5:
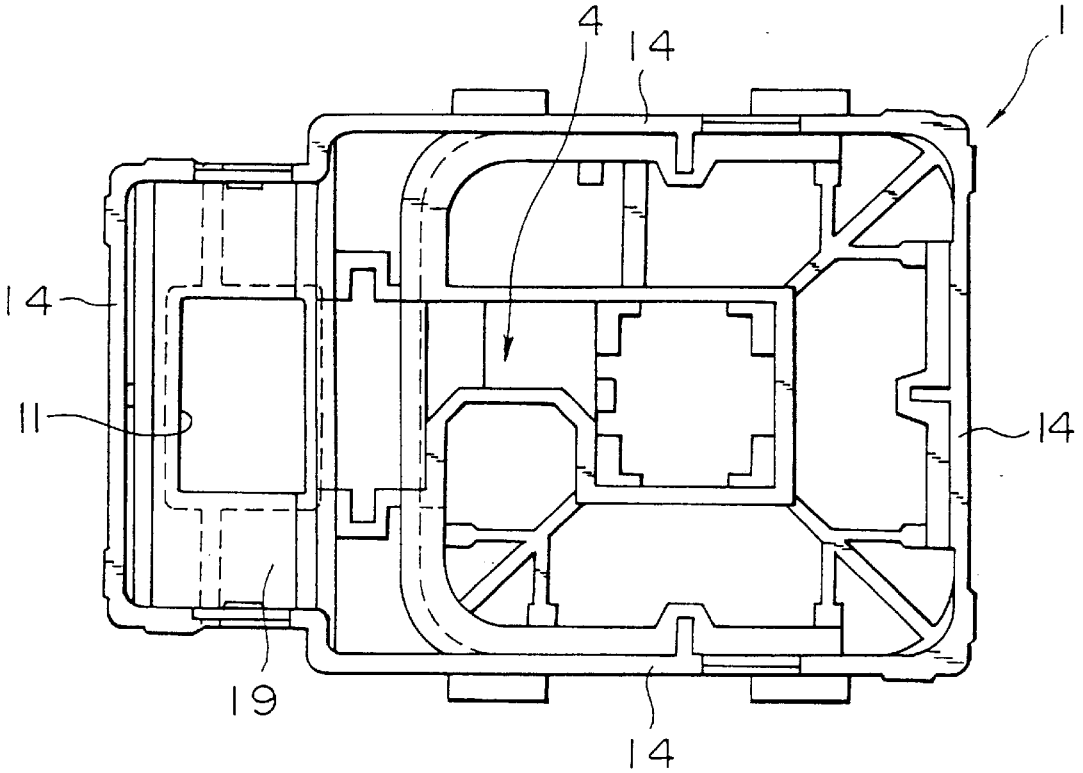
FIG. 5 is a bottom view of the housing in the embodiment of the present invention.
Figure 6:
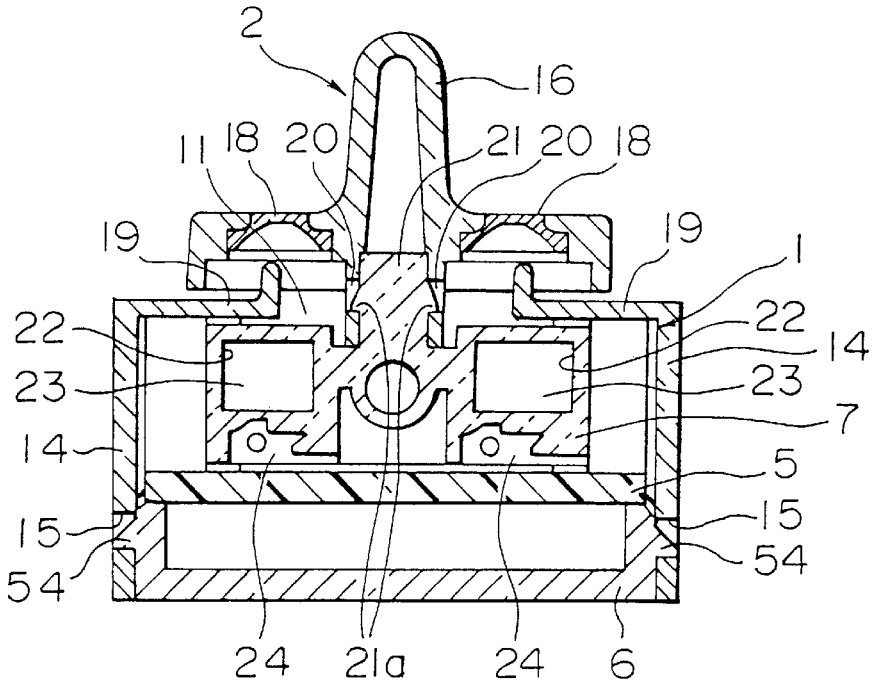
FIG. 6 is a longitudinal section of the knob in the neutral position in the embodiment of the present invention.
Figure 7:
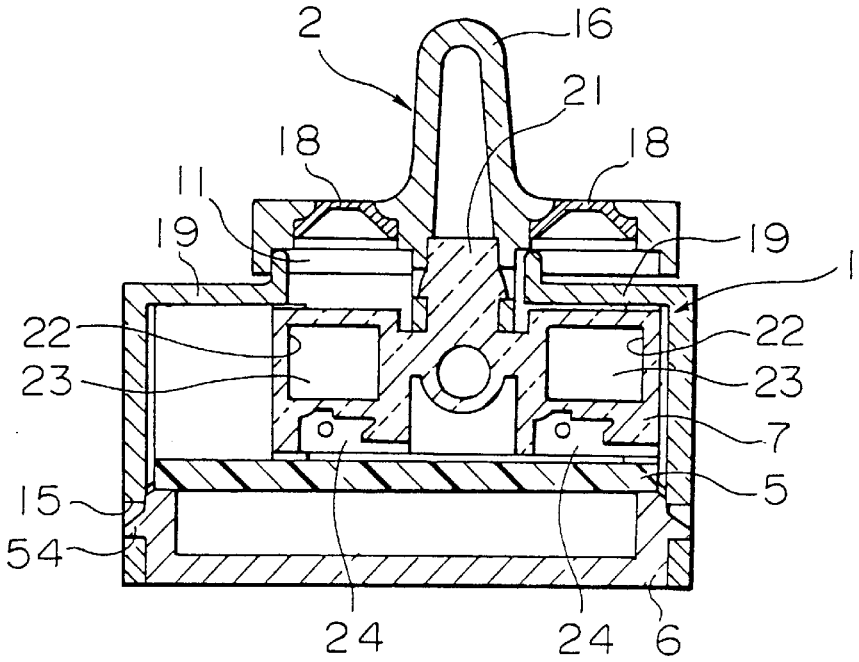
FIG. 7 is a longitudinal section of the knob moved in one direction from its neutral position in FIG. 6.

FIG. 1 is an exploded perspective view showing an embodiment of the present invention. FIG. 2 is a plan view of FIG. 1. FIG. 3 is a longitudinal side elevational view cut along line III—III of FIG. 2. FIG. 4 is a perspective view showing in detail the light-guiding member and the slider portion. FIG. 5 is a bottom view of the housing. FIG. 6 is a longitudinal section of the knob at the neutral position. FIG. 7 is a longitudinal section of the knob moved in one direction from the position of FIG. 6.

As shown in FIG. 1, the mirror switch apparatus primarily includes a housing 1 with an open bottom, a slide knob 2 for selectively controlling left and right mirror driving motors (not shown), a paddle knob 3 which is an operating member for setting the mirror leftward, rightward, upward, or downward, a light-guiding member 4 for guiding light to the slide knob 2, a printed circuit board 5 having printed thereon, for example, a pattern of a plurality of stationary contacts, and a bottom plate 6 which is a cover for securing the light-guiding member 4 and the printed circuit board 5 along with the housing 1.

The housing 1 has an opening 11 formed in its top surface for inserting therein the bottom of the slide knob 2 of a slide switch portion, a pair of light-intercepting portions 19 formed on both sides of the opening 11 so as to extend in the sliding direction of the slide knob 2, a substantially rectangular-shaped accommodating recess 12 for inserting therein the bottom of the paddle knob 3 of a four-direction switch portion, and side faces 14 formed from each of the side edges of the top surface.

A supporting base 13 is integrally formed with the accommodating recess 12 at substantially the center thereof for rockably supporting the bottom of the paddle knob 3, as described hereafter. A pair of retainer recesses 15, spaced by a predetermined distance, are formed at each lower portion of one of a pair of opposing side faces 14.

The slide knob 2 is disposed above the top surface of the housing 1 and slidably fittingly inserted into the opening 11 of the housing 1 in the longitudinal direction. The center of top face of the slide knob 2 is formed as a knob portion 16 which the operator moves with his fingers when operating the knob 2. Transparent indicators (slide switch indicators) 18, molded from two components, are formed on both sides of the knob portion 16 in the sliding direction in the form of arrows indicating directions, characters, and symbols. A square-shaped cylindrical connector is formed in the center of the bottom surface of the slide knob 2, and engaging recesses 20 are formed at the opposing walls of the connector.

A slider member 7, integrally formed with the slide knob 2, is slidably accommodated in the housing 1. The slide knob 2 and the slider member 7 form the slider.

The slider member 7 is made of transparent synthetic resin and has a connector 21 projecting from the center of the top surface of the slider member 7, as shown in FIGS. 3 to 6. The connector 21 of the slider member 7 is inserted into the opening 11 of the housing 1 and fitted to the connector of the slider knob 2. An engaging protrusion 21*a* of the connector 21 of the slider member 7 engages the engaging recesses 20 of the slider knob 2, whereby the slide knob 2 and the slider member 7 are snappingly connected together. Gaps are formed between the bottoms of the indicators 18 of the slide knob 2 and the slider member 7 for placing the light-intercepting portions 19 therein.

Accordingly, when the slide knob 2 is moved in a reciprocating fashion along the opening 11 from above the housing 1, the slider member 7 also reciprocates in the same direction. The length of the slider member 7 in the direction of movement is such that when the slider member 7 is moved in one direction and the connector 21 engages one end of the connector 21 the portion on the other side of the connector 21 located on the starting end of the sliding movement is located below the opening 11.

Two rectangular recesses 22 are formed in a side face extending in a direction perpendicular to the direction of movement of the slider 7, with the recesses 22 formed substantially horizontally and being separated by a distance equal to the thick-walled portion of the knob portion 16. The ends of the two recesses 22 incline upward from the bottom to the top, so that light, coming from a side face opposing the side face in which the openings of the recesses 22 are formed, is reflected upward by inclined reflecting surfaces 23. As shown in FIG. 3, each reflecting surface 23 inclines forwardly and upward from the bottom toward the top surface. Spaced movable contact accommodating recesses 24 are formed at both ends of the lower face of the slider member 7, and accommodate flat movable contacts 25, respectively. A blind hole (not shown), which is formed in the side face at the side of the openings of the recesses 22 of the slider member 7, accommodates a ball 27 by means of a spring 26. The ball 27 operates to elastically press-contact against the side face 14 of the housing 1 disposed in the vicinity thereof in a direction parallel to the movement of the slide knob 2 in order to retain the slide knob 2 in the two switching positions and the neutral position so as to cause the operator to feel a click.

The paddle knob 3 includes a substantially cylindrical body 31, a top portion 32 covering the top surface of the body 31, and a skirt 33 which extends substantially horizontally from the bottom edge of the body 31. The top portion 32 is divided into four divisions, each having an indicator 34 formed substantially at the center thereof. Each indicator 34 is formed of transparent material, is molded from two components, and is disposed at the underside of the top portion 32. Retainer pawls 35 are formed so as to extend vertically downward from four locations at the center of the underside of the top portion 34 of the paddle knob 3 and engage the edge of the supporting base 13. Seven operating poles 36 are formed at the underside of the top portion 32 in order to press rubber contact plate 8 (described later). These poles are spaced apart so as to surround the supporting base 13.

The light-guiding member 4 is made of transparent synthetic resin and includes a light-incoming portion 37 positioned at the center of the supporting base 13 of the housing 1, and a light-guiding portion 38 which extends from one side of the light-incoming portion 37 and having one end disposed in the vicinity of and in opposing relationship to the side face which opposes the side face in which the openings of the recesses 22 of the slider member 7 are located. An opening 39 is formed so as to pass vertically through the center of the light-incoming portion 37. The light-guiding member 4 is placed above the rubber contact plate 8.

The rubber contact plate 8 is composed of an insulating and transparent rubber or synthetic resin sheet. It includes rubber spring portions 41 and an illumination dome 42. The rubber spring portions 41 are skirts positioned oppositely of the bottom ends of the operating poles 36 of the paddle knob 3, during assembly. The illumination dome 42 is fitted into the opening 39 of the light-guiding member 4. The top faces of the rubber spring portions 41 come into contact with the bottom faces of the operating poles 36, whereby the paddle knob 3 is elastically held. A movable contact (not shown) is provided at the top inside surface of each rubber spring 41 portion.

The printed circuit board 5 includes a plurality of stationary contacts 45 and two pairs of stationary contacts 46. The plurality of stationary contacts 45 are positioned such that the movable contacts of the rubber spring portions 41 can contact them when any of the rubber spring portions 41 of the rubber contact plate 8 is pressed by the associated operating pole 36 of the paddle knob 3. The stationary contacts 46 are contacted by the movable contacts 25 of the slider member 7. A round hole 48 for passing the lighting lamp 47 therethrough is formed at substantially the center of the portion bounded by the stationary contacts 45. The layout patterns of the stationary contacts 45 and 46 are connected to connector pins 52 (described later). Reference numerals 49 denote small holes for receiving the connector pins 52.

The bottom plate 6, fitted to the open end of the housing 1, forms the outer shell of the switch apparatus. The connector pins 42 are raised from the bottom face 51 having the printed circuit board 5 placed thereon, and a holding portion 53 for holding the lighting lamp 47 is formed integrally with the bottom face 51. Retainer pawls 54 are formed at the peripheral edges of the bottom plate 6 in correspondence with the number of retainer recesses 15 of the housing 1.

A description will now be given of the operation of the mirror switch apparatus having such a construction in the case where the lighting lamp 47 is lit. During driving, the lighting lamp 47 may be turned on at all times, or may be lit with the turning on of the headlight.

As shown in FIG. 6, when the slide knob 2, projecting from the top portion of the housing 1, is in the neutral position, the mirror driving motor is not driven, even when the paddle knob 3 is pressed. When the slide knob 6 is in the neutral position, the slider member 7 is also in the neutral position, with the connector 21 positioned at substantially the center of the opening 11.

Therefore, the indicators 18 disposed on each side of the knob portion 16 are illuminated in the following way. Light from the lighting lamp 47 travels from the light-incoming portion 37 to the light-guiding portion 38 of the light-guiding member 4. Then, it leaves the end of the light-guiding portion 38 to illuminate the side face of the slider member 7, and is reflected upward by the two reflecting surfaces 23 of the slider member 7. The reflected light passes through the opening 11 to illuminate both of the indicators 18. When the slide knob 2 is in the neutral position, both of the indicators 18 are bright, thus making it possible for the operator to easily recognize that the mirror switch apparatus is in the neutral position. For the paddle knob 3, the indicators 34 on the top portion 32 of the paddle knob 3 are illuminated by light from the lighting lamp 47 which has passed through the illumination dome 42 of the rubber contact plate 8, so that all of the indicators 34 are bright.

As shown in FIG. 7, when the slide knob 2 in the neutral position is moved toward the right, the movable contacts 25, accommodated in the right movable contact accommodating recess 24, comes into contact with the two right stationary contacts 46 of FIG. 1 on the printed board, whereby the right mirror driving motor is ready to be driven. At this time, as shown in FIG. 7, the right light-intercepting portion 19, disposed below the right indicator 18, comes between the slide knob 2 and the slider member 7 to shield the light path from light, causing the right indicator 18 of the slide knob 2 to become dark.

On the other hand, the left indicator 18 moves away from the left light-intercepting portion 19 and arrives above the opening 11, so that light from the lighting lamp 47 reflected by the left reflecting surface of the slider member 7 reaches the left indicator 18 of the slide knob 2 to illuminate the left indicator 18. Accordingly, the indicator illuminated is the indicator 18 at the starting end of the sliding movement, so that the left indicator 18 indicates an indicator mark pointing toward the right, that is the direction of operation is indicated by the indicator at the starting end of the sliding movement (FIG. 2).

In this way, when a location of the paddle knob 3 is pressed, after the right mirror driving motor has been set to a driving waiting state, the pressed portion causes the rubber spring portion 41 of the rubber contact plate 8 located below the pressed portion to deform. As a result of this, the movable contact of the deformed portion contacts the stationary contact 45 on the printed circuit board located therebelow, thereby turning on the motor. Based on the on signal, the right mirror driving motor rotates forward or backward, generating a driving power which is transmitted to the right mirror by means of a driving power transmission system (not shown) to drive it. In this case, the rubber spring portion 41 of the rubber contact plate 8 is deformed, which allows the operator to confirm the on operation by feeling a predetermined click. Releasing the rubber spring portion 41 causes the paddle knob 3 to return to the state of FIG. 3 due to the restoring force of the spring rubber portion 41, as a result of which the switch apparatus is turned off.

In the present embodiment, the indicator mark of the indicator 18 of the slide knob 2 is a triangular mark with its apex pointing in the direction of operation. However, for example in FIG. 2, the upper indicator 18 may indicate operation toward the left by the letter L, while the lower indicator 18 may indicate operation toward the right by the letter R.

In the present embodiment, although the mirror switch apparatus was taken as an example, the present invention is not limited thereto, so that the present invention also applies to various other switch apparatuses. When operating different apparatuses with the slide knob 2, the indicators 18 may indicate the name or symbol marks of the apparatuses to be operated by the switch apparatus.

According to the present embodiment, the switch apparatus comprises slider (slider portions 2, 7) having two indicator portions 18 slidably disposed and spaced apart in the sliding direction; a contact portion 25 for allowing switching operations by sliding the slider (slider portions 2, 7); illuminating lamp 47 for illuminating the indicator portions 18 of the slider (slider portions 2, 7); a pair of light-intercepting portions 19, each preventing the light from the illuminating lamp 47 from reaching the associated indicator portion 18 disposed at the end towards which the slider (slider portions 2, 7) is slid; and an opening 11 formed between the pair of light-intercepting portions 19 for allowing transmission of the light from the illuminating lamp 47 to the indicator portions 18 in order to illuminate the indicator portions 18, wherein when the slider is slid in the neutral position both of the indicator portions 18 are illuminated by the light transmitted through the opening 11 from the illuminating lamp 47; and wherein when the slider (slider portions 2, 7) is slid in one direction, the indicator portion 18 at the side towards which the slider (slider portions 2, 7) is slid is prevented from being illuminated by the light-intercepting portion 19 at the side towards which the slider (slider portions 2, 7) is slid, whereas the other indicator portion 18 is illuminated by the light from the illuminating lamp 47 opposing the opening 11. Accordingly, in such a construction, when the slider (slider portions 2, 7) slides, light from the illuminating lamp 47 passes through the opening 11 at the starting end of the sliding movement to illuminate the slider switch indicator portion 18 at the starting end of the sliding movement and the light is prevented from reaching the other slide switch indicator portion 18 by the light-intercepting portion 19. Consequently, the switching state can be reliably indicated even in dark places by indicating on the slide switch indicator the apparatus, which operates as a result of switching operations, or the direction or the function of the apparatus.

In addition, the operator can easily know the switching condition of the switch apparatus in dark places, such as, for example, that the switch apparatus is turned off when the two indicator portions are illuminated at the same time, since the slide switch indicator portions are illuminated when the switch apparatus is in the neutral position.

According to the present embodiment, the lighted switch apparatus comprises four direction switch portions for performing switching between multiple directions by operating a paddle knob 3 in four directions; one illuminating lamp 47 disposed below the four direction switch portions; a light-guiding member 4 having an opening 39 for allowing positioning of the illuminating lamp 47 so as to extend beyond the illuminating lamp 47, and disposed outwardly of the four direction switch portions; a four direction switch indicator portion disposed at the paddle knob 3 and illuminated by the light from the illuminating lamp 47 extending beyond the opening 39 of the light-guiding member; a slide switch portion having a slider (slider portions 2, 7) which allows the light of the illuminating lamp 47 transmitted from the light-guiding means 4 to impinge upon the switch portion and slide in a direction perpendicular to the longitudinal direction of the light-guiding member 4; slide switch indicator portions 18 spaced apart in the sliding direction of the slider (slider portions 2, 7); reflecting surfaces 23, disposed in the slider (slider portions 2, 7) in correspondence with the slide switch indicator portions 18, for reflecting the light from the light-guiding member 4 to the indicator portions 18; a pair of light-intercepting portions 19, each preventing the light from the illuminating lamp 47 from reaching the associated indicator portion 18 at the side towards which the slider (slider portions 2, 7) is slid; and an opening 11 formed between the pair of light-intercepting portions 19 for allowing transmission of the light from the illuminating lamp 47 to the indicator portions 18 of the slider (slider portions 2, 7) to illuminate the slide switch indicator portions 18, wherein the four direction switch indicator portions are illuminated by the light from the illuminating lamp 47 extending beyond the opening 39 of the light-guiding member 4; and wherein the light-guiding member 4 guides the light from the illuminating lamp 47 to the reflecting surfaces 23 of the slider (slider portions 2, 7), so that when the slider (slider portions 2, 7) is slid in the neutral position both of the indicator portions 18 are illuminated by the light transmitted through the opening 11 from the illuminating lamp 47, and when the slider (slider portions 2, 7) is slid in one direction the slide switch indicator portion 18 at the side towards which the slider (slider portions 2, 7) is slid is prevented from being illuminated by the light-intercepting portion 19 at the side towards which the slider (slider portions 2, 7) is slid, whereas the other the slide switch indicator portion 18 is illuminated by the light from the illuminating lamp 47 opposing the opening 11. Therefore, in the switch apparatus having the above-described advantages of the first form, it is possible to illuminate the indicators 18 of the two switch portions using one illuminating lamp 47, since the illuminating lamp 47 illuminates the indicator portion 18 by emitting light which is guided to the reflecting surfaces 23 of the slider (slider portions 2, 7) of the slide switch apparatus, and illuminates the four direction switch indicator portions 34 which are located above the light source means.

According to the first form of the present invention, the switching state can be reliably indicated even in dark places by indicating on the slide switch indicator the apparatus, which operates as a result of switching operations, or the direction or the function of the apparatus. This is achieved by virtue of a construction in which the slider slides to allow light to pass through the opening at the starting end of the sliding movement to illuminate the slider switch indicator portion at the starting end of the sliding movement and to prevent light from reaching the other slide switch indicator portion.

In addition, the operator can easily know the switching condition of the switch apparatus in dark places, such as, for example, that the switch apparatus is turned off when the two indicator portions are illuminated at the same time, since the slide switch indicator portions are illuminated when the switch apparatus is in the neutral position.

According to the second form of the present invention, in the switch apparatus having the above-described advantages of the first form, it is possible to illuminate the indicators of the two switch portions using one light source means, since the light source illuminates the slide switch indicator portion by emitting light which is guided to the reflecting surfaces of the slider of the slide switch apparatus, and illuminates the four direction switch indicator portion which is located above the light source means.

What is claimed is:

1. A lighted switch apparatus, comprising:

a slider disposed to slide along a sliding direction, said slider having two indicator portions spaced apart in the sliding direction;

a contact portion for performing switching operations by sliding said slider between a neutral position and a contact position;

light source means for illuminating said indicator portions of said slider;

a pair of light-intercepting portions, each preventing the light from said light source means from reaching an associated one of said two indicator portions; and an opening formed between said pair of light-intercepting portions for transmitting the light from said light source means to said indicator portions in order to illuminate said indicator portions, wherein when said slider is in the neutral position both of said indicator portions are illuminated by the light transmitted through said opening from said light source means; and wherein when said slider is in the contact position, one of said indicator portions is prevented from being illuminated by said light-intercepting portion associated with said one of said indicator portions, whereas the other of said indicator portions is illuminated by the light from said light source means transmitted through said opening.

2. A lighted switch apparatus, comprising:

a four direction switch portion for performing switching between multiple directions by operating a paddle knob in four directions;

one light source means disposed below said four direction switch portion;

a light-guiding member having an opening, said light source means disposed in said opening of said light-guiding member, and a light-guiding portion extending beyond said four direction switch portion;

a four direction switch indicator portion disposed at said paddle knob and illuminated by said light source means;

a slide switch portion having a slider formed to transmit the light of said light source means transmitted from said light-guiding member to impinge upon said switch portions and which slides, between a neutral position and a contact position, in a direction perpendicular to the longitudinal direction of said light-guiding member;

slide switch indicator portions spaced apart in the sliding direction of said slider;

reflecting surfaces, disposed in said slider in correspondence with said slide switch indicator portions, for reflecting the light from said light-guiding member to said slide switch indicator portions;

a pair of light-intercepting portions, each preventing the light from said light source means from reaching an associated one of said slide switch indicator portions; and an opening formed between said pair of light-intercepting portions for transmitting the light from said light source means to said slide switch indicator portions of said slider to illuminate said slide switch indicator portions, wherein said light-guiding member guides the light from said light source means to said reflecting surfaces of said slider, so that when said slider is in the neutral position both of said slide switch indicator portions are illuminated by the light transmitted through said opening formed between said pair of light-intercepting portions from said light source means, and when said slider is in the contact position one of said slide switch indicator portions is prevented from being illuminated by said associated light-intercepting portion, whereas the other of said slide switch indicator portions is illuminated by the light from said light source means transmitted through said opening formed between said pair of light-intercepting portions.

* * * * *